US007980898B2

(12) United States Patent
Chatterjee

(10) Patent No.: US 7,980,898 B2
(45) Date of Patent: Jul. 19, 2011

(54) AUGMENTED SMALL FORM-FACTOR CONNECTOR

(75) Inventor: Manjirnath Chatterjee, San Francisco, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 267 days.

(21) Appl. No.: 12/266,550

(22) Filed: Nov. 6, 2008

(65) Prior Publication Data

US 2009/0124125 A1 May 14, 2009

Related U.S. Application Data

(60) Provisional application No. 60/986,752, filed on Nov. 9, 2007.

(51) Int. Cl.
*H01R 24/00* (2011.01)

(52) U.S. Cl. ..... 439/660; 439/607.05

(58) Field of Classification Search ..... 439/607.05, 439/660, 676, 638, 639, 378
See application file for complete search history.

(56) References Cited

U.S. PATENT DOCUMENTS 7,393,247 B1 * 7/2008 Yu et al. ..... 439/638
7,641,518 B2 * 1/2010 Lee et al. ..... 439/660
7,670,191 B2 * 3/2010 Ortega et al. ..... 439/660

* cited by examiner

*Primary Examiner* — Edwin A. Leon
(74) *Attorney, Agent, or Firm* — Mahamedi Paradice Kreisman LLP; Van Mahamedi

(57) ABSTRACT

A connector that is structured to electrically and physically connect with (i) a first connector type using a first set of electrical contacts, and (ii) a second connector type that uses the first set of electrical contacts and a second augmenting set of electrical contacts.

18 Claims, 7 Drawing Sheets

AUGMENTED SMALL FORM-FACTOR CONNECTOR

RELATED APPLICATIONS

This application claims benefit of priority to provisional U.S. Patent Application 60/986,752, filed Nov. 9, 2007, entitled MICRO CONNECTOR FOR DATA AUDIO AND POWER. The aforementioned priority application is hereby incorporated by reference in its entirety for all purposes.

TECHNICAL FIELD

The disclosed embodiments relate generally to the field of connectors. In particular, embodiments described herein relate to an augmented connector for mobile and small form-factor devices.

BACKGROUND

The Universal Serial Bus (USB) is a connector standard that is in wide use. Currently, numerous standard bodies exist (USB 2.0) for enumerating requirements for implementation with USB connectors, including requirements for performance, hardware, form factor and various data transfer and connectivity protocols. As the USB connector becomes more popular and widespread, more applications and standards are adopted for the USB. In particular, there has been an effort to adopt standards by which the form factor of the USB becomes smaller, and has use in a variety of applications and environments in order to accommodate increasingly mobile and new computing devices.

As the name indicates, the USB connector acts as a data bus. In a standard mode of operation, the user is able to connect numerous devices to a single port using hubs. When devices are connected to a host, the host acts as a controller for all USB communications that enter through a particular port.

In general, the USB connector has a physical layer that includes hardware for implementing the data transfer protocol by which data is passed through the USB connector. The physical layer performs several functions, including serialization and de-serialization of transmissions, encoding and decoding of the signals. Across the USB connector, the protocol implemented provides for data packets that include token, data, and handshake packets.

Numerous standards have been and are currently being developed for the USB. These standards accommodate new smaller form factors, such as Mini-USB, as well as new data transfer protocols (e.g. USB 2.0). There is also a new standard for wireless USB ports. In addition, new standards accommodate use of USB connectors in various environments and applications. One standard is provided with "On-the-Go" which enables two devices connected through a USB port to negotiate for the role of the host. In particular, the On-The-Go Standard has introduced a Host Negotiation Protocol for enabling one device to act as host and controller in a one-to-one pairing.

Another more specific standard is the CEA-936A standard, which provides for use of Mini-USB connectors. Another new standard that has been implemented is the Micro-USB standard.

The trend towards smaller and more capable mobile computing devices has increasingly required more functionality and reduced dimensions from the connector interfaces of such devices The development of the Micro-USB standards has been part of the effort to enhance the usability of such connectors while reducing the dimensions of such connectors.

As an example, the USB CE 936A spec (also know as the USB-IF) specifies multiplexing data, analog audio and "mic" signals on two USB data pins (also called "D+" and "D−" pins). However, this configuration raises a problem: the connector cannot be used at the same time to transfer analog audio and digital data. Other shortcomings are present in this configuration as well. For example, under the standard, the mic and the right data channel are multiplexed onto to the same USB pin. This configuration precludes use of the connector as a stereo headset with a mic.

Numerous enhancements to standard USB connectors have been implemented. For example, one solution provides for the multiplexing of audio on to the data and ID pins to allow the use of analog headset via a physical adapter. This solution allows for the use of stereo headset with mic. However it also does not allow the use of digital devices at the same time as the analog headset that is in use.

In order to enhance the functionality of USB connectors, other solutions have provided for the use of extra pins. For example, some solutions have provided for physically augmenting a USB connector to allow for electrical and physical compatibility with other connectors of the same type, while adding extra pins for items such as analog audio and future expansion. However, such solutions have not worked under tight physical tolerances. Specifically, the configurations proposed for added pins have not accommodated limitations brought by the requirements of thin insulative housing structures and tight electrical termination tolerance required to achieve high data speeds (480 mbits per second at the current time with future expansion planned to 5 gbits per second).

FIG. 7A through FIG. 7E illustrate a prior art Micro-Universal Serial Bus (USB) connector, as adopted by the USB Implementers Forum, Inc. ("USB-IF"), in the UNIVERSAL SERIAL BUS MICRO-USB CABLES AND CONNECTORS SPECIFICATION, Revision 1.01 dated Apr. 4, 2007 ("Micro-USB Specification"). With reference to FIG. 7A, a front end view of a Micro-USB plug connector 700 as defined under the Micro-USB Specification is shown. The plug connector 700 includes a housing 710 having a mating structure 712 from which a set of electrical contacts 720 are provided. Part of mating structure 712 includes a shaped void 714 for receiving the corresponding mating structure of the receptacle connector (see FIG. 7B). The mating structure 712 may be formed from insulative material that is molded or otherwise shaped to retain the electrical contacts 720. Circuit elements (not shown) may carry signal lines from the electrical contacts to a connected device or cord.

The housing 710 and its mating structure 712 may include dimensions and an outward protruding shape that collectively defines the form factor of the plug connector 700. Both the form factor and the pin layout of the connector conform to the Micro-USB Specification, which dictates specific dimensions and pin assignments. In particular, the pin layout adopted by the USB-IF assigns each contact element to one of (i) a ground, (ii) voltage reference, (iii) identity, (iv) data (D+), or (v) D−.

FIG. 7B shows a receptacle connector 740 that is adapted to mate with the plug connector 700. The receptacle connector may also include a housing 750 with a mating structure 752, corresponding receptive void 754 (for receiving the mating structure of the plug connector) and set of electrical contacts 760 that conform to the Micro-USB Specification. As such, receptacle connector 740 can physically and electrically mate with the plug connector 700. Accordingly, the mating structure 752 may mirror that of the plug connector 700. Likewise, the set of electrical contacts 760 may include the pin layout of the plug connector, with the electrical contacts of each connector being aligned and positioned to electrically connect when the two connectors are mated.

With reference to FIG. 7A and FIG. 7B, the Micro-USB Specification provides for active physical connections to be formed between two mating connectors. Accordingly, the plug connector 700 includes biased securement tabs 730 that are extended outward and oriented to move inward towards a top surface 734 of the housing 710 for plug connector 700 when the receptacle connector 740 is engaged. Specifically, when the receptacle connector 740 is engaged, the tables 730 bias inward into the top surface 734 and enable the receptacle connector 740 to move over the plug connector 700 (where the corresponding mating structure 712, 752 of each connector 700, 740 aligns and mates with the corresponding void 714, 754 of each connector). The receptacle connector 740 may include corresponding recessed structures 762 which can align with the biased securement tabs to enable the securement tabs to extend and obstruct movement of the two connectors with respect to one another.

FIG. 7C illustrates conventional spring-type electrical contacts 770 that may be used on a Micro-USB connector. The spring-type electrical contacts 770 bias when engaged, and can cause an active electrical connection to be formed with an individual electrical contact. FIG. 7D illustrates a pad-type electrical contact 772 that may be used. The pad-type electrical contact 772 may mate with sprint electrical contacts 770 as shown in FIG. 7E.

DETAILED DESCRIPTION

Figure 1A:
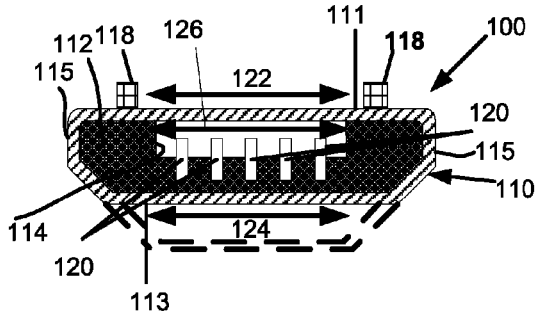
FIG. 1A illustrates a plug-type connector that may be augmented with additional contact elements at any one of multiple possible positions, according to one or more embodiments.

Embodiments described herein provide for a connector that is structured to electrically and physically connect with (i) a first connector type using a first set of electrical contacts, and (ii) a second connector type that uses the first set of electrical contacts and a second augmenting set of electrical contacts. In an embodiment, a connector is capable of mating with other connectors that comply with a standard or specification, such as one promulgated by an industry organization (e.g. USB-IF). At the same time, the connector is capable of mating with another type of connector that includes additional contact elements to enhance the connection that would otherwise be available with the first type of connector.

In an embodiment, a connector includes a connector housing that provides a mating structure, a first set of electrical contacts, and a second set of electrical contacts. The connector housing defines a perimeter of the connector. The first set of electrical contacts are retained by the mating structure, and are positioned to be received or mated with a corresponding set of contact elements of another connector in order to (i) transfer data on two or more contacts, (ii) supply a voltage signal on another of the contacts, and (iii) provide a ground for the connection formed by the two connectors. The connector further comprises a second or augmenting set of electrical contacts that are apart from the first set and provided in an alternative configuration or layout.

The use of an augmenting set of electrical contacts enables the connector to be used with (i) mating connectors that provide mating electrical contact elements for just the first set of contact elements, and (ii) mating connectors that provide mating electrical contact elements for both the first set and second set of electrical contact elements. In some embodiments, the connector can also mate with other connectors that include electrical contact elements for only the second or augmenting set of electrical contact elements.

In an embodiment, the second set of electrical contact elements are extended from one or more walls of the physical structure that form the perimeter. Such electrical contact elements may be insulated from the connector housing by providing the electrical contact elements on a layer of insulative material (such as the same material for the mating structure).

Among other advantages, embodiments described herein allow for the simultaneous use of data, power charging, analog audio, and extra expansion while maintaining electrical and physical compatibility with the existing Micro-USB connector. In addition, embodiments described herein enable the use of simple wire adapters, also known as pass through adapter to connect simple accessories such as headsets and which do not require any circuitry or logic. Furthermore, one or more embodiments provide for the use of simple pass thru adapters (also known as "Y" cables) to allows the simultaneous attachment of multiple accessories to a single USB micro jack. These and other applications may be accomplished by dedicating or assigning individual contact elements that augment those used in implementing, for example, a standard promulgated by a Standards Body.

Numerous embodiments described herein assume connectors for use as augmented USB type connectors. As such, the connectors are capable of forming a connection with a conventional USB connector of appropriate standard and configuration. In an ability of such embodiments to form a USB connection, one or more embodiments assume a pin layout or configuration such as described with FIG. 7A and FIG. 7B (ground, voltage reference, identity, and two data lines). Furthermore, one or more embodiments provide that the USB connection satisfies many of the requirements for use as small form-factor connectors (e.g. Micro-USB), or with mobile and/or mobile environments (e.g. On-The-Go, CEA-936A). Other embodiments may apply to other forms of serial bus connections, such as, for example, serial bus connections that are compliant with the IEEE 1394 (so called "Firewire") standards.

Still further, many embodiments described herein pertain to Micro-USB connectors. As used herein, a Micro-USB connector is a plug or receptacle connector that is defined by the "Universal Serial Bus Micro-USB Cables and Connectors Specification", Revision 1.01 and published Apr. 1, 2007 by the USB Implementers Forum.

Numerous types of computing devices may be used with embodiments described herein. One type of computing device that may be employed with one or more embodiments include mobile or portable computing devices, including wireless devices for use in messaging and telephony applications using cellular networks. Such devices are sometimes called "smart phones", "hybrid devices" or "multi-function devices". Mobile computing devices are generally small enough to fit in one hand, but provide cellular telephony features in combination with other applications. Examples of such other applications include contact applications for managing contact records, calendar applications for managing and scheduling events, task applications for keeping lists, and camera applications for capturing images. Additionally, many types of messaging transports may be provided on such mobile computing devices, including SMS, MMS, email and instant messaging.

Other examples of mobile computing devices contemplated for use with one or more embodiments described herein include portable media players, global positioning system devices, personal digital assistants, portable gaming machines, and/or devices that combine functionality of such devices. In addition, at least some embodiments described herein are applicable to desktop computers, laptops, and computer appliances (e.g. set-top boxes). A typical environment on which one or more embodiments may be implemented include a wireless telephony device that can be placed in an automobile or other mobile environment, and communicate with any one of a plurality of devices that include chargers, and both active and passive media headsets. Another environment on which one or more embodiments may be implemented includes a small form factor portable device (e.g. digital camera) that can be used to connect with a video output device.

In one embodiment, a system for providing serial bus connectivity includes a connector component that provides a plurality of signal lines. The connector component is configured to mate with a connector component of another device, so as to extend communications with the other device using the plurality of signal lines. The system also includes a physical layer coupled to the connector component to (i) receive input signals from the plurality of signal lines, and to (ii) send output signals over the plurality of signal lines.

One or more embodiments described herein provide that methods, techniques and actions performed by a computing device are performed programmatically, or as a computer-implemented method. Programmatically means through the use of code, or computer-executable instructions. A programmatically performed step may or may not be automatic.

Additionally, or more embodiments described herein may be implemented using modules. A module may include a program, a subroutine, a portion of a program, or a software component or a hardware component capable of performing one or more stated tasks or functions, or alternatively, a hardware component configured through software or other programmatic elements. As used herein, a module can exist on a hardware component independently of other modules, or a module can be a shared element or process of other modules, programs or machines.

The use of terms such as "component" or "element", when presented in the context of software or programming, may refer to code that can be executed to perform a stated function or task. Such code may execute or be shared with other components or elements, even when a component or element is described or shown to be disparate from other components.

Furthermore, one or more embodiments described herein may be implemented through the use of instructions that are executable by one or more processors. These instructions may be carried on a computer-readable medium. Machines shown in figures below provide examples of processing resources and computer-readable mediums on which instructions for implementing embodiments of the invention can be carried and/or executed. In particular, the numerous machines shown with embodiments of the invention include processor (s) and various forms of memory for holding data and instructions. Examples of computer-readable mediums include permanent memory storage devices, such as hard drives on personal computers or servers. Other examples of computer storage mediums include portable storage units, such as CD or DVD units, flash memory (such as carried on many cell phones and personal digital assistants (PDAs)), Secure Digital (SD) memory cards, and magnetic memory. Computers, terminals, network enabled devices (e.g. mobile devices such as cell phones) are all examples of machines and devices that utilize processors, memory, and instructions stored on computer-readable mediums.

Overview

FIG. 1A illustrates a plug-type connector that may be augmented with additional contact elements that are provided at any one of multiple possible positions, under an embodiment. In particular, an embodiment provides an augmented plug connector 100 that conforms to at least two specifications for connectors. Accordingly, one or more embodiments provide that the plug connector 100 includes a first set of contact elements 120 that conform to specifications for enabling the plug connector 100 to mate with a first type of connector and a second type of connector. In one embodiment, the first type of connector may correspond to any type of connector that conforms to a conventional promulgated industry standard (such as Micro-USB). At the same time, one or more embodiments provide that the plug connector 100 is augmented to include additional contact elements, that when combined with the first set of contact elements, enable the connector 100 to be coupled to a second type of connector. In particular, embodiments provide that the plug connector 100 is augmented with an additional set of contact elements that are positioned or distributed in one or more augmentation regions. Such additional contact elements may be provided for use in carrying data and/or power, as described in greater detail below.

In more detail, connector 100 includes a shell 110 that encapsulates and retains a mating structure 112 having one or more voids 114 (for receiving opposing mating structures of another connector. The mating structure 112 may include the first set of electrical contacts 120 that have a first layout or configuration. The shell 110 may form at least a partial perimeter of connector 100. The specific cross-sectional shape of shell 110 may vary somewhat, depending on design considerations.

As mentioned, embodiments described herein provide for connector 100 to be matable with two type of data connectors. The first type of data connector that can be mated with connector 100 may be in adherence to a specification that governs configuration or construction of the connector and its mate. This standard or specification may specify both form factor considerations and pin layout. In one implementation, the specification is standardized, meaning its part of a standard promulgated by an organization acting on behalf of industry (e.g. a Standards Body). For example, as mentioned, the connector 100 may be configured to mate with any corresponding Micro-USB Connector (e.g. a conventional receptacle connector such as shown in FIG. 7B). As such, the pin layout (configuration of the electrical contacts 120) may conform to, for example, the USB standard, with each of the five electrical contacts representing one of ground, voltage reference, identity, first data line, and second data line. Likewise, the shape of shell 110 may conform to shape and dimensional considerations promulgated under the Micro-USB standard. However, the standard (or other design considerations) may provide for more than one physical form factor. For example, the cross-sectional shape may be rectangular or include an optional bottom opening 126 (shown in phantom). As such, the shell 110 may provide a portion of the overall housing or housing shape.

Figure 1E:
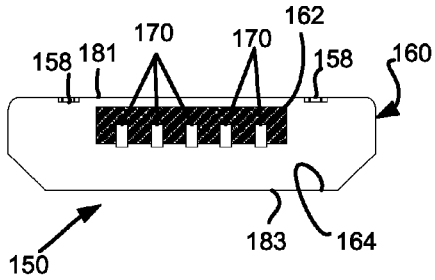
FIG. 1E illustrates a receptacle type connector that may be augmented with additional contact elements at any one of multiple possible positions, under an embodiment.

As mentioned, connector 100 is also matable with a second type of connector using a second set of electrical contacts that are provided or distributed with one of the augmentation regions. In an embodiment, the second type of connector includes additional contact elements that exceed the pin configuration of the specification of the connector of the first type. The connector 100 uses (i) its form-factor or shape (as defined by structure 112 and/or housing 110) to physically mate with the connectors of both the first and second types; (ii) the first set of electrical contacts or pins to electrically mate with corresponding contacts of the first type of connector; and (iii) both the first set of electrical contacts and the second set of electrical contacts to mate with the second type of connector. Thus, connector 100, when mated with the second type of connector (such as shown by FIG. 1D) provide an augmented connector that enhances the electrical functionality that would otherwise be provided from just the first type of connector.

According to embodiments, the augmentation regions on which the second set of contact elements are provided include one or more exterior augmentation regions and/or interior augmentation regions. The possible exterior augmentation regions include a top augmentation regions 122 corresponding to contact elements that are distributed on the top façade 111 of the shell 100, and the bottom augmentation region 124 where contact elements are distributed on the bottom façade 113. However, any of the other exterior surfaces of the connector 100 may be used, including surfaces on either lateral façade 115 of shell 110 or housing.

The interior augmentation regions may be provided inside the perimeter formed by the shell 110 or housing of the connector. Depending on design and implementation, the interior augmentation region may be formed on interior facades or within regions of the mating structure 112. In one embodiment, a first interior augmentation region 126 may be provided on an interior of the top façade 111. A second interior augmentation region (not shown) may be provided on an interior of the bottom façade 113. Likewise, any of the lateral facades 115 may include interior surfaces that include one or more contact regions (so as to provide an augmentation region). As another alternative or addition, the interior augmentation regions may be formed into an opening of the mating structure 112.

As a plug connector, the connector 100 may include biased securement tabs 118, 118 on opposing sides of top façade 111 for purpose of enabling the connector to maintain an active connection with a corresponding receptacle connector. The bias securement tabs 118, 118 may be pushed inwards into a biased state when a receptacle connector 140 (see FIG. 1D) is passed over the shell 110 or housing of the connector. The bias securement tabs may then expand outward to engage corresponding recesses 158 (see FIG. 1D), to mechanically retain the two connectors against one another.

Figure 1B:
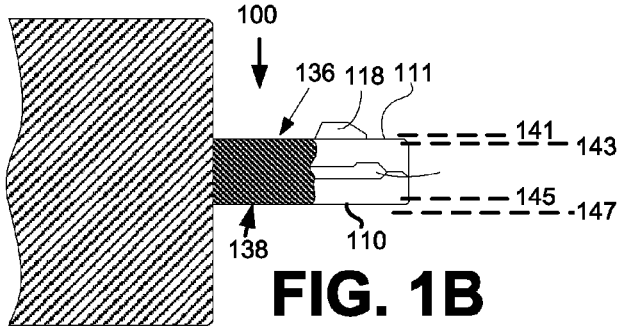
FIG. 1B is a side view of FIG. 1A, illustrating possible positions of additional contact elements to augment a connector of FIG. 1A.
Figure 1F:
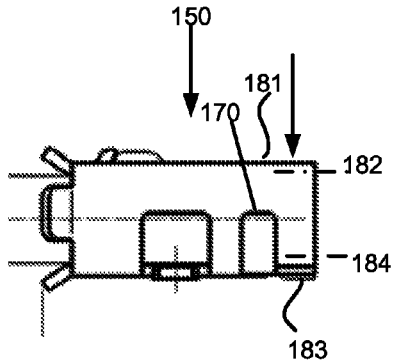
FIG. 1F illustrates an interior (top or bottom) surface of the connector of FIG. 1E, with additional contact elements that augment the connector, under an embodiment.

FIG. 1B is a side view of FIG. 1A, illustrating possible positions of additional contact elements to augment a connector of FIG. 1A, under an embodiment. In particular, connector 100 may include a base structure 136 that extends into housing 138 (which may also be provided as part of the shell 110). The top façade 111 may include securement tabs 118. Individual contact elements 120 of the first set may extend within the shell 110. Possible augmentation regions that may be incorporated into embodiments described herein include a first augmentation plane 141 of the top façade 111, a second augmentation plane 143 on an interior of the top façade 111, a third augmentation plane 145 on an interior of the bottom façade 113, and/or on a fourth augmentation plane 147 on an exterior of the bottom façade 113. Each augmentation regions may include a layer or thickness of insulative material on which a row or other distribution of contact elements is provided. As an addition or alternative, other augmentation planes for including individual contact elements of the second set include above or below the interior structure 112, as well as on or near (exterior or interior) lateral facades 115 (see FIG. 1A).

Different types of electrical contacts may be used in the augmentation regions, according to one or more embodiments. For example, spring-type electrical contacts (see FIG. 7C) or pad-type electrical contacts (see FIG. 7D) may be used. As alternatives, dimples, bumps, wipers or other contact elements may be used.

Figure 1C:
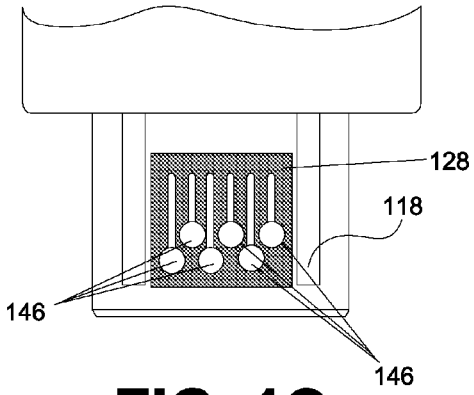
FIG. 1C is a top view of FIG. 1A under a configuration in which spring-type electrical contacts is provided on a top surface of the connector.
Figure 1D:
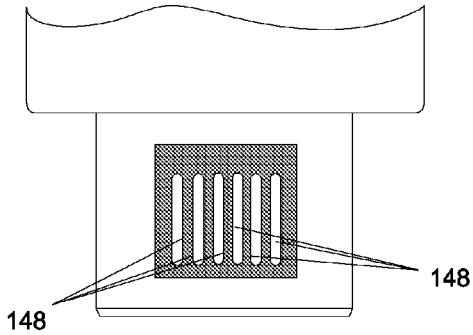
FIG. 1D is a bottom view of FIG. 1A under an alternative configuration in which spring-type electrical contacts is provided on a bottom surface of the connector.

With reference to FIG. 1C, a top view of a connector of FIG. 1A is shown in which second set of electrical contacts 146 are provided on the top façade 111 of connector 100. FIG. 1D illustrates an alternative in which the second electrical contacts 148 are provided on an interior of the top façade 111. Each set of electrical contacts may be disposed on a layer of insulative material, which is molded or otherwise integrated to the connector housing. Either of the embodiments shown may incorporate alternative types of electrical contacts. For example, an embodiment of FIG. 1C may incorporate pad-type contacts 148 (shown in FIG. 1D), while an embodiment of FIG. 1D may use spring-type contacts 146. While an embodiment of FIG. 1C and FIG. 1D illustrate variations to placement of electrical contacts on or about the front façade 111, other embodiments may utilize other surface or places within the connector 100 to include the second set of electrical contacts. Moreover, while embodiments shown with FIG. 1C and FIG. 1D provide for 6 additional (or augmented) second set of contacts, other embodiments may utilize more or fewer contacts in the second set. For example, the augmented second set of electrical contacts and include 2-14 additional contact elements in other implementations. Still further, a single electrical contact may be provided as an augmented electrical contact. Thus, numerous variations to the number and configuration of the electrical contacts provided in the augmented set are possible.

FIG. 1E illustrates a receptacle type connector that may be augmented with additional contact elements at any one of multiple possible positions, according to an embodiment. An embodiment such as shown in FIG. 1E may be used to mate with a connector such as shown with any an embodiment described with FIG. 1A. More specifically, a receptacle connector 150 such as shown by FIG. 1E may include an additional set of contact elements (so as to have two sets of contact elements) in order to couple with connector 100 (see FIG. 1A).

In an embodiment, receptacle connector 150 includes a housing 160 having an interior mating structure 162 and void 164. The interior structure 162 and void 164 are shaped to receive and physically mate with corresponding void and mating structures of connector 100. Similarly, one implementation provides that a first set of electrical contacts 170 include five pins: ground, voltage reference, identity, and a pair of data lines (per, for example, USB-IF standards for Micro-USB). Thus, as mentioned with an embodiment of FIG. 1A, the receptacle connector 150 may conform to a specification, such as the Micro-USB Specification or other specification of a Standards Body. As such, embodiments provide that one type of connector that the receptacle connector 150 may be mated with is a conventional Micro-USB connector. Additionally, the receptacle connector 150 is matable with an augmented connector that adds at least a second set of electrical contacts to enable transfer of additional power or data (in addition to the first set of electrical contacts).

More specifically, embodiments provide that the connector 150 includes a second set of electrical contacts that augment the electrical functionality of the receptacle connector when it is mated with a corresponding second type of connector. The second set of electrical contacts may be provided or otherwise distributed in one or more augmentation regions of the connector. As the receptacle connector 150 is designed to be paired with the plug connector 100 of any of the embodiments described in FIG. 1A, the receptacle connector 150 may include one or more augmentation regions that align or pair with corresponding regions of the connector 100. In this way, receptacle connector 150 provides a second or alternative type of connector for the plug connector 100. Likewise, the plug connector 100 (FIG. 1A) provides a second or alternative type of connector for the receptacle connector 150. In this way, the receptacle connector 150 uses (i) its form-factor or shape (as defined by structure 162 and/or housing 160) to physically mate with the connectors of the first type (e.g. conventional or standardized plug connector) and the second type; (ii) the first set of electrical contacts 170 or pins to electrically mate with corresponding contacts (e.g. first set of electrical contacts 120) of the first type of connector 100; and (iii) both the first set of electrical contacts 170 and a second set of electrical contacts (as distributed in an augmentation region) in order to mate with the second type of connector (e.g. plug connector 100).

FIG. 1F illustrates a side view of receptacle connector 150, with one or more possible augmentation regions on which additional contact elements of a second set may be provided or distributed, under an embodiment. As mentioned with previous embodiments, receptacle connector 150 can include multiple augmentation planes on which electrical contacts of the second set may be provided. These augmentation planes include a first augmentation plane 182 on an interior of the top façade 181 (which can be used to align with contact elements on the top façade of the connector 100), a second augmentation plane 184 on an interior of the bottom façade 183 (which can be used to align with contact elements on the bottom façade of the connector 100) or a third augmentation plane 186 positioned interior the connector 150 so to be provided above or below the mating structure 162. Other augmentation regions may also be used, including those that align contact elements to mate with corresponding elements of connector 100 with its augmentation region. Thus, as mentioned with previous embodiments, receptacle connector 150 can include multiple augmentation planes on which electrical contacts of the second set may be provided. These augmentation planes may be combined or integrated with, for example, the casing or shell structure, so as to be provided on an interior of the façade. These contacts may be formed over insulative material that is bonded to the shell or casing.

Figure 2A:
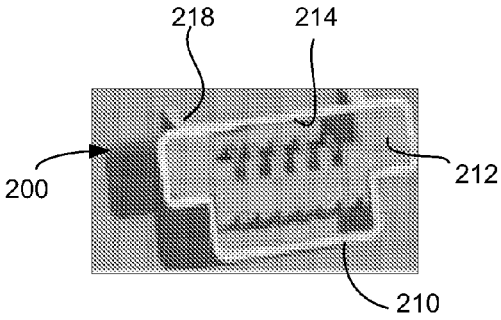
FIG. 2A is a front isometric view of an augmented plug connector, according to an embodiment.

FIG. 2A is a front isometric view of an augmented plug connector, according to an embodiment. A plug connector 200 may conform to Micro-USB specifications and include an augmented set of contact elements. As such, connector 200 may be matable with both (i) conventional receptacle connectors that conform only to a specific (standard such as to the Micro-USB specification), and (ii) augmented receptacle connectors such as shown with an embodiment of FIG. 2D. As mentioned, the augmented receptacle connector uses an additional or augmented set of contact elements (beyond the Micro-USB specification).

In more detail, connector 200 includes a housing 210 that defines at least a portion of a perimeter of the connector. A mating structure 212 is formed interior to the housing 210. The mating structure 212 may be molded or otherwise formed from insulative material that insulates electrical contacts embedded therewith, while providing structure to position the contacts and extend electrical connectivity to the contacts. The mating structure 212 may be shaped to be received by corresponding voids in the receptacle connectors. A set of interior contacts 220 (e.g. standard conforming contacts) is provided by the mating structure. In one implementation, the set of interior contacts 220 are provided in an alignment and configuration that conforms to the Micro-USB standards. Likewise, connector 200 includes void 214 to enable reception and mating with corresponding mating structures that carry mating electrical contact elements (See FIG. 2D). In particular, a receptacle connector (such as shown by either FIG. 7B or an embodiment of FIG. 2D) may be mated with the plug connector 200 shown. As previously described, the biased securement tabs 218 may bias inwards to enable a housing of the receptacle connector to pass over the plug connector housing 210. When positioned properly, the securement tabs may bias outward and create an active physical connection between the two connectors.

Figure 2D:
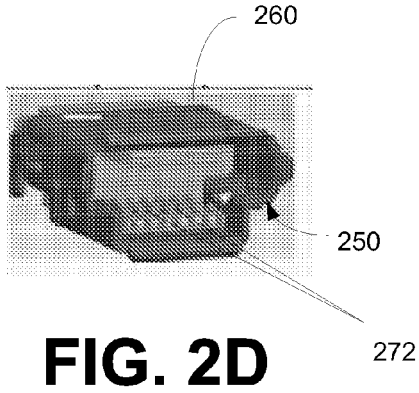
FIG. 2D is a front isometric view of an augmented receptacle connector, according to an embodiment.
Figure 2B:
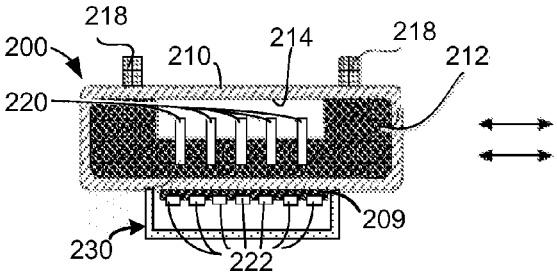
FIG. 2B is a front-end view of an augmented plug connector of an embodiment of FIG. 2A.
Figure 2E:
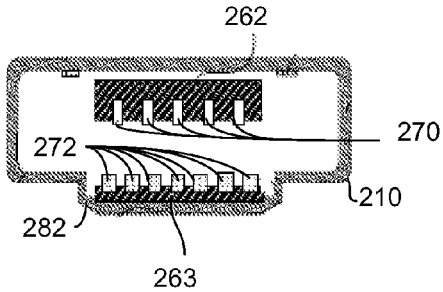
FIG. 2E is a front-end view of an augmented receptacle connector of an embodiment of FIG. 2D.
Figure 2C:
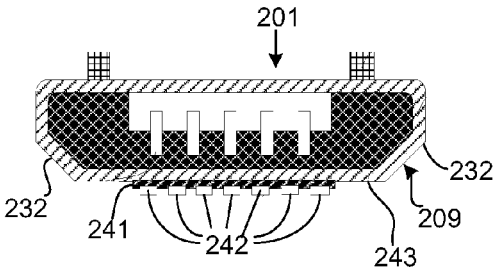
FIG. 2C is a front-end view of an augmented plug connector according to a variation of an embodiment of FIG. 2A.

In an embodiment shown by FIG. 2A through FIG. 2C, the mating structure 212 carries an augmented set of electrical contacts 222 on a bottom facade 213 of the mating structure 212. The particular configuration and count may vary depending on functionality required. In an embodiment shown, the augmented set of contact elements includes seven additional contacts. When connector 200 is mated with a conventional Micro-USB connector, only the first set of contact elements are mated and used. When connector 200 is mated with a like-designed receptacle connector with augmented contact elements, the connector 200 may use both the conventional and the augmented set of contact elements 220, 222.

FIG. 2B is a representative front-end view of an augmented plug connector of an embodiment of FIG. 2A. In an embodiment shown by FIG. 2A and FIG. 2B, the augmenting set of electrical contacts 222 may be in the form of pad-type electrical contacts (e.g. see FIG. 7D) that are formed on a perimeter portion of the mating structure 212. As an alternative, the augmenting set of electrical contacts 222 may be formed on an exterior or interior side of the bottom section 230 of the connector 200. If no bottom section is provided, the exterior or interior side of the housing 210 forming the bottom façade may carry the augmenting set of electrical contacts 222. When the augmenting set of contacts 222 stems from the exterior or housing (rather than the mating structure 212), a layer of insulative material may be used to retain and electrically isolate the individual contacts of the augmenting set from the housing 210 (which in some cases can form a grounding plane).

As further illustrated by FIG. 2A and FIG. 2B, the housing 210 may be shaped to include an optional bottom extension 230 that includes a portion of the mating structure 212 and the augmented set of contact elements 222. The augmented set of contact elements 222 may be provided interior to the housing 210. In such an implementation, the housing 210 may define two rounded rectangular shapes. Different variations to the shape of a plug connector such as described by embodiments herein are provided.

In FIG. 2C, a front-end view of an augmented plug connector is provided, according to a variation of an embodiment of FIG. 2A. In FIG. 2C, an augmented connector 201 includes housing 209 having angled walls 232 that define a seven-sided connector interface. Such a housing configuration may reduce an overall dimension of the connector. In order to accommodate an augmented set of electrical contacts 242, an embodiment such as shown distributes the augmented set of electrical contacts on an insulative layer 211 molded or otherwise formed onto an exterior bottom façade 243 of the housing 209. As mentioned with FIG. 2A and FIG. 2B, the electrical contacts may be pad-type contact elements.

FIG. 2D is a front isometric view of an augmented receptacle connector, according to an embodiment. A receptacle connector 250 includes a housing 260 and a mating structure 262 having a set of electrical contacts 270. A set of augmenting electrical contacts 272 may be provided on an interior side of a bottom façade 263. In this manner, the receptacle connector 250 is configured to mate with the plug connector 200 in a manner that provides for electrical connectivity to be established between the set of electrical contacts 220 (FIG. 2A) and 270 (e.g. a conventional Micro-USB connection), and between the augmenting set of electrical contacts 222, 272. In an embodiment, the receptacle connector 200 may also mate with a conventional Micro-USB connector using only the set of electrical contacts 270. As such, the mating structure 262 and overall form factor and shape of the hosing 260 conform to the Micro-USB specifications.

FIG. 2E is a front-end view of the augmented receptacle connector of an embodiment of FIG. 2D, according to an embodiment. The augmenting set of electrical contacts 272 may include spring-type contact elements (see FIG. 7C) formed on an interior of the bottom façade 263. An additional layer 282 of insulative material (e.g. molding, adhesive) may buffer or space the augmenting electrical contacts 272 from the housing 210 (which may actually serve as a grounding plane), while isolating the electrical contacts and enabling the electrical contacts to receive mating counterparts.

Figure 2F:
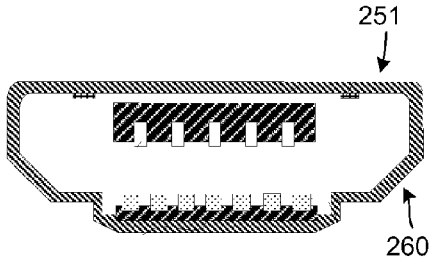
FIG. 2F is a front-end view of an augmented receptacle connector according to a variation of an embodiment of FIG. 2D, and in conformance to a form-factor of FIG. 2C.

FIG. 2F is a front-end view of an augmented receptacle connector 251, according to a variation of an embodiment of FIG. 2D, and in conformance to a form-factor of FIG. 2C. An embodiment such as shown illustrates that the housing 260 of receptacle connector can include alternative non-rectangular design.

Figure 3A:
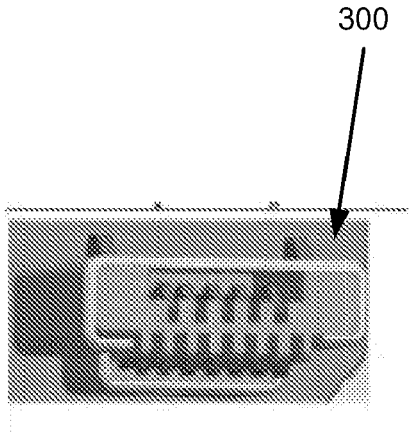
FIG. 3A is a front isometric view of an augmented plug connector, according to another embodiment.
Figure 3C:
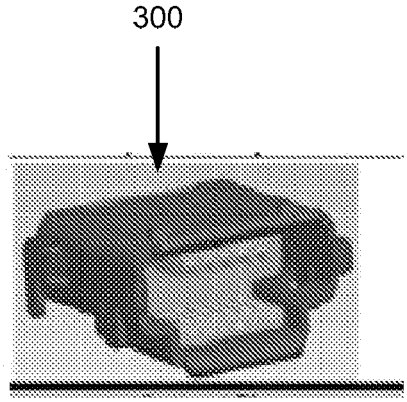
FIG. 3C is a front-end view of an augmented plug connector according to a variation of an embodiment of FIG. 3A.
Figure 3B:
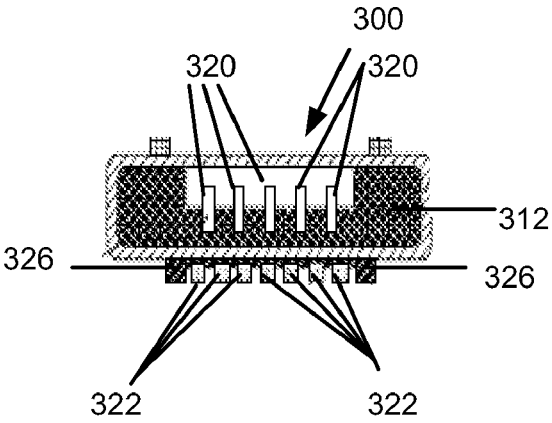
FIG. 3B is a front-end view of an augmented plug connector of an embodiment of FIG. 3A.

FIG. 3A and FIG. 3B illustrate an augmented plug connector 300, according to another embodiment. FIG. 3A and FIG. 3B may parallel the plug connector 300 depicted with embodiments of FIG. 2A and FIG. 2B, with exception that an augmenting set of electrical contacts 322 is formed from spring-type contact elements (See FIG. 7C). The spring-type contact elements may be molded or otherwise retained by an augmenting section or portion 326 of the mating structure (or similar formation). This enables the contact elements to have electric isolation and structure to receive and mate with counterpart electrical contacts. As described, the augmenting set of electrical contacts augment supplement the set of electrical contacts 320 (which may conform to a specification, or alternatively, to an industry standard).

Figure 3D:
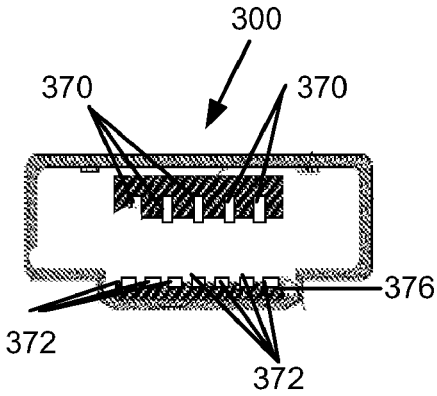
FIG. 3D is a front isometric view of an augmented standardized receptacle connector, according to an embodiment.

FIG. 3C and FIG. 3D illustrate an augmented receptacle connector 350 that is configured to mate with a connector such as shown and described with FIG. 3A and FIG. 3B. A set of interior or conforming electrical contacts 370 may be provided by mating structure 362. Additionally, an augmenting set of electrical contacts 372 may be provided by pad-type electrical contact elements that are distributed in an additional insulative layer 376 or structure formed against the interior of the bottom façade of the housing. In other ways, receptacle connector 350 may parallel the construction of the receptacle connector such as shown by FIG. 2D and FIG. 2E. Thus, the augmenting pad-type electrical contact elements 372 may supplement the contact elements in the mating structure 262 that may conform to a standard or other connector specification.

FIG. 3A through FIG. 3D illustrate that different types of electrical contacts may be employed on plug connectors (and correspondingly on receptacle connectors) depending on the implementation and considerations. For example, spring-type contact elements are more likely to wear and break with use. Thus, the use of such contact elements may be preferred on a component that is cheaply or readily replaceable (e.g. accessory device). The pad-type contact elements are more durable, and may be distributed on a more expensive component (e.g. mobile computing device). Accordingly, an embodiment provides that the receptacle connector 350 of FIG. 3C and FIG. 3D may be integrated with, for example, a mobile computing device, while the corresponding plug connector 300 of FIG. 3A and FIG. 3B is included in a cable or with an accessory device.

Figure 4A:
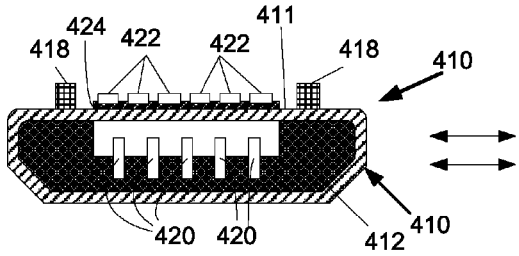
FIG. 4A is a front-end view of an augmented plug connector having additional contact elements of a first type on an exterior top surface, under an embodiment.

FIG. 4A is a front-end view of an augmented plug connector, according to another embodiment. Similar to construction of plug connectors described with other embodiments, a plug connector 400 includes housing 410 having mating structure 412, with a set of electrical contacts 420 distributed within the mating structure. In one implementation, the set of interior electrical contacts 420 are configured to comply with the Micro-USB standard. Accordingly, five contact elements are provided in the set: ground, voltage reference, identity, and a pair of data signal lines. The mating structure 412 and the overall form factor of the connector 400, in combination with the first set of electrical contacts 420, enable the connector to mate with a conventional Micro-USB receptacle connector such as shown with FIG. 7B.

The second set of contact elements 422 augment connector 400 and are provided on a top façade 411 of the connector 400. In an implementation shown, six contact elements are distributed on the top façade 411, between biased securement tabs 418, 418 that can bias to retain the receptacle connector in a mechanically active coupling. The second set of augmenting contact elements 422, in combination with the first set of contact elements 420, combine to enable the plug connector 420 to mate with an augmented connector such as shown with FIG. 4D and FIG. 4E, and described elsewhere in the application.

In other embodiments, more or fewer contact elements may be distributed as part of the augmenting set of electrical contacts. Still further, the contact elements 422 are pad-style contact elements (see FIG. 7D). Other implementations may provide for a spring-style contact element (see FIG. 7C).

Figure 4C:
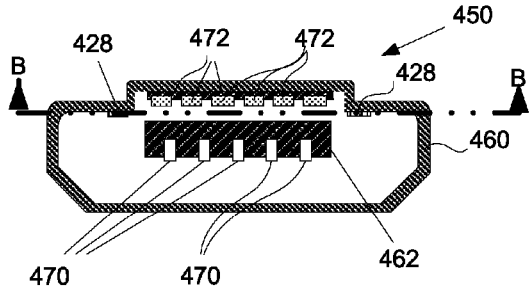
FIG. 4C is a front-end view of an augmented receptacle connector having additional contact elements on an interior perimeter surface, according to an embodiment.
Figure 4B:
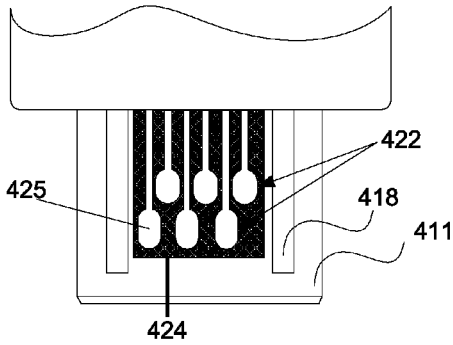
FIG. 4B is a top view of a plug connector of an embodiment of FIG. 4A.

FIG. 4B is a top view of the plug connector 400 of FIG. 4A, according to an embodiment. In an implementation shown, the set of augmenting electrical contacts 422 are pad-type elements. The electrical contacts 422 may be provided on top façade 411, between biased securement tabs 418. A layer of insulative material 424 is disposed between the electrical contacts 422 and the housing 410, in order to electrically insulate the electrical contacts. The pad-type electrical contacts may be provided in an arrangement in which each contact element includes an enlarged pad area 425. Adjacent contact elements may be disposed in staggered arrangement so as to maximize the dimension of the enlarged area 425 (so as to enable formation of better electrical contact with the spring-type electrical contact element of the corresponding receptacle connector).

FIG. 4C illustrates a receptacle connector that is matable with a connector such as shown in FIG. 4A or FIG. 4B, under an embodiment. The receptacle connector 450 includes a housing 460, a mating structure 462 and a first set of contact elements 470. The interior set of contact elements 470 may comply with electrical specification and pin layout of a specification such as the Micro-USB standard. In an embodiment, a second set of augmenting contact elements 472 are positioned to make electrical contact with the corresponding augmenting set of electrical contacts of plug connector 400. In order to make electrical contact when the plug connector 400 and receptacle connector 450 are mated, the augmenting set of electrical contact elements are provided on an interior side of the top façade 461. The number and distribution pattern of the two augmenting sets of electrical contacts may align to ensure electrical contact is made when the two connectors are mated. In an implementation in which the augmenting set of electrical contacts 422 of the plug connector 400 is a pad-type contact element, the corresponding augmenting set on the receptacle set 450 may be provided as sprint-type contact elements.

Figure 4D:
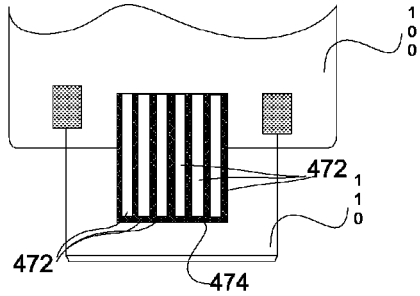
FIG. 4D is a cross-sectional view of the interior perimeter surface of a connector of FIG. 4E, along lines B-B.

FIG. 4D is an upward view of a cross-section along lines B-B of FIG. 4C, under another embodiment. As mentioned, the augmenting set of contact elements 472 may be in the form of spring-style contact elements. The augmenting set of contact elements 472 may be disposed over a layer 474 of insulative material that insulates the electrical elements from the housing 410. When the spring-style contact elements 472 are mated with corresponding pad-style elements 422, an active retention force may be used to maintain the electrical connection.

Figure 4E:
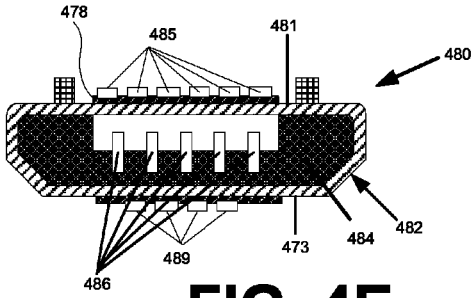
FIG. 4E is a front-end view of an augmented plug connector having additional contact elements on two exterior surfaces, according to another embodiment.
Figure 4F:
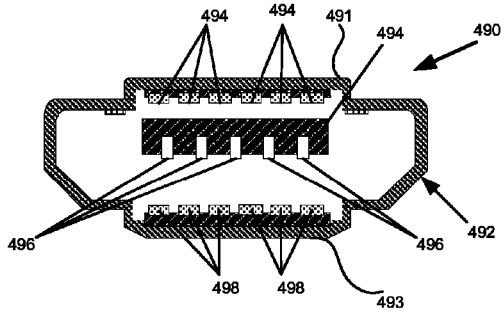
FIG. 4F is a front-end view of an augmented receptacle connector having additional contact elements on an interior of two exterior surfaces, to accommodate a plug connector such as shown with an embodiment of FIG. 4E, according to another embodiment.

FIG. 4E and FIG. 4F illustrate a plug and receptacle connector combination that illustrate another embodiment. In FIG. 4E, an alternative plug connector 480 is shown, similar to a construction or design of a plug connector shown in FIG. 4A. The connector 480 includes a housing 482 and insulative mating structure 484 which provides an interior set of electrical contact elements 486. The interior set of electrical contact elements 486 may conform to a specification for a connector style that does not use the augmenting set of contact elements. For example, as mentioned with other embodiments, the interior set of electrical elements 486 may conform to a Micro-USB plug connector. In an embodiment shown, the augmenting contact elements may be distributed into two or more augmenting regions. In an embodiment shown, a first set of augmenting electrical contact elements 485 is distributed on an exterior side of the top façade 481 of the housing 480, similar to design and configuration shown with FIG. 4A and other elements. Accordingly, a layer 478 of insulative material may be formed on the top façade 481 to insulate the first set of augmenting electrical contacts.

In an embodiment shown, a second set of augmenting electrical contacts 489 is distributed on an exterior side of a bottom façade 473 of the housing 482. In the configuration shown, the top set of augmenting electrical contacts has more contact elements than the bottom augmenting set (six contacts to four). In an implementation shown, each of the top/bottom augmenting sets of electrical contacts is a pad-style electrical contact. Alternatively, one or both of the augmenting set of electrical contacts may use alternative types of electrical contacts (e.g. spring-type contact elements).

Figure 7A:
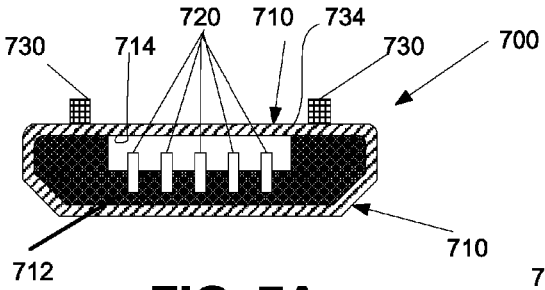
FIG. 7A (Prior Art)
FIG. 7A illustrates a Micro-Universal Serial Bus (USB) plug connector, under the prior-art.
Figure 7B:
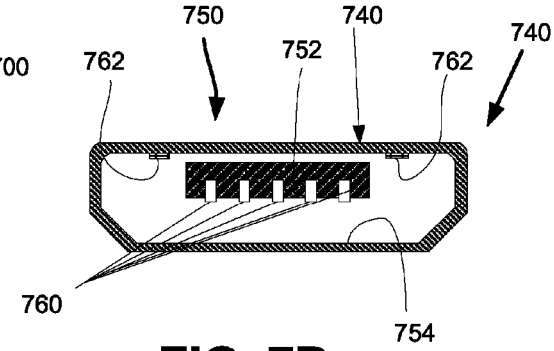
FIG. 7B (Prior Art)
FIG. 7B illustrates a Micro-USB receptacle connector, under the prior-art.
Figure 7C:
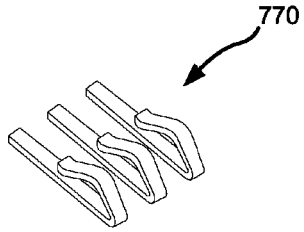
FIG. 7C (Prior Art)
FIG. 7C illustrates spring-type contact elements for use with Micro-USB connectors, under the prior art.
Figure 7D:
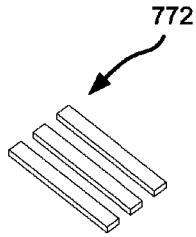
FIG. 7D (Prior Art)
FIG. 7D illustrates pad-type contact elements for use with Micro-USB connectors, under the prior art.
Figure 7E:
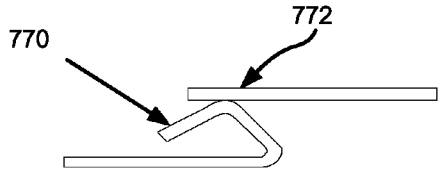
FIG. 7E (Prior Art)
FIG. 7E illustrates an electrical contact made between a pad and spring type contact element, under the prior art.

FIG. 4F illustrates a receptacle connector that can mate with both a plug connector of FIG. 4E and a conventional plug connector of FIG. 7A (or other conventional style connector). The receptacle connector 490 includes a housing 492 having an internal mating structure 494. An interior set of electrical contacts 496 is provided by the mating structure 494. The interior set of electrical contacts 496 can electrically mate with corresponding contacts of the plug connector 480 (see FIG. 4E) and of another style connector (i.e. connector of FIG. 7A).

The receptacle connector 490 includes two sets of augmenting contact elements that are interior to the connector housing 492. The first set of augmenting contact elements 494 is provided underneath the top façade 491 and is aligned and configured (numbered and arranged) to electrically mate with the augmenting set of contact elements on the top façade 481 of the plug connector 480. The second set of augmenting contact elements 498 may be provided on an interior side of the bottom façade 493 and is aligned and configured to electrically mate with the augmenting set of contact elements on the bottom façade 473 of the plug connector 480.

When mated, the plug connector 480 and receptacle connector 490 form an augmented connector combination that uses 15 electrical contacts to exchange data and power. Separately, each of the plug connector 480 and the receptacle connector 490 is capable of mating and being used with a non-augmented connector, using the interior set of electrical contacts. Thus, in an implementation, plug connector 480 may be mated with a conventional Micro-USB receptacle connector (such as shown with FIG. 7B). Likewise, receptacle connector 490 may be mated with a conventional Micro-USB plug connector such as shown with FIG. 7A.

Figure 5A:
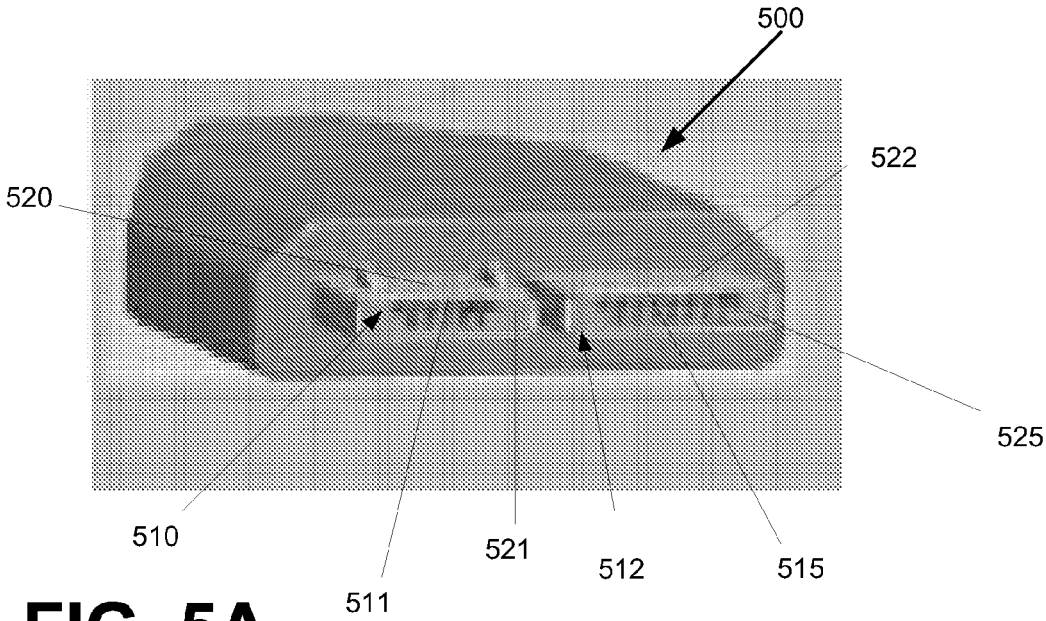
FIG. 5A is an isometric view of an augmented plug connector having two mating structures, under an embodiment.

FIG. 5A is an isometric view of an augmented plug connector having two mating structures, according to an embodiment. The augmented connector 500 may include two connector interfaces 510, 512, provided in a side-by-side arrangement. While each connector interface 510, 512 of the connector 500 may provide either a receptacle or plug type connector, embodiments assume the interfaces are both either plug or receptacle type. In the example shown by FIG. 5A, connector 500 is a plug connector. Accordingly, one connector interface 510 is configured to comply with the specification of a first type of connector, and the other connector interface 512 is configured to comply with the connector interface of another specification. As with other embodiment, the first connector interface 510 may be configured to be in compliance with Micro-USB or other standardized connector specification.

Accordingly, one implementation provides for connector interface 510 to include a set of standardized contact elements 511 positioned interior to the connector interface, similar to, for example, a connector of FIG. 7A. The second connector interface 512 may include a second set of electrical contacts 515 that are disposed in any region of the interface. The second set of electrical contacts 515 conform to another specification (e.g. such as a proprietary specification). Each interface 510, 512 includes a corresponding housing 520, 522 with a respective mating structure 521, 525 that positions the electrical contacts of that interface in a configuration of the specification or standard to which that interface conforms to. In the example shown, the electrical contacts of the second connector interface 512 are disposed interior, similar to the conventional approach of FIG. 7A. However, the second set of electrical contacts 515 may be displaced on any augmentation plane or surface, such as described with any other embodiment.

Figure 5B:
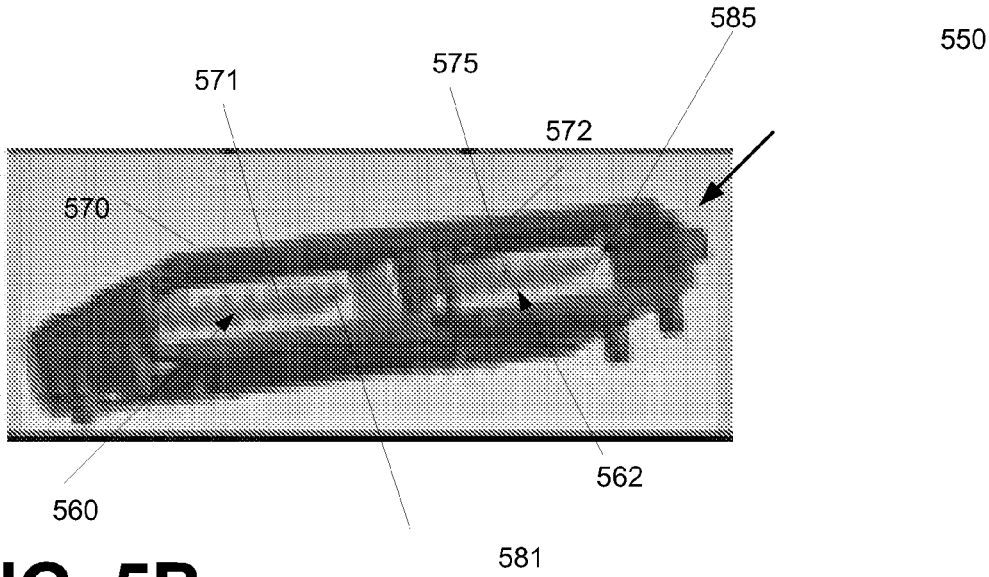
FIG. 5B is an isometric view of an augmented receptacle connector having two mating structures, as shown with an embodiment of FIG. 5A, under another embodiment.

FIG. 5B is an isometric view of an augmented receptacle connector having two mating structures, according to an embodiment. A receptacle connector 550 may be configured with interfaces 560, 562 to mate with corresponding interfaces of the plug connector 500. Each interface 560, 562 may include a corresponding housing 570, 572 and mating structure 581, 585 from which respective electrical contacts 581 and 585 are provided. The configuration of each set of electrical contacts 571, 575 may be based on the standard or specification that the particular interface is conforming to. The conformance of each interface 560, 562 to the standard or specification may be based on the form factor, as well as the shape and design of the mating structures 580, 582, as well as the configuration in which the mating structures dispose the corresponding electrical contacts. The mating structures 580, 582 may be molded or otherwise formed to insulate and enable the respective electrical contacts of each interface to be available for contact with a matable form factor connector, such as shown by plug connector 500 (FIG. 5A). In this way, each connector interface 560, 562 is configured for one of the interfaces 510, 512 of the plug connector 500, so that when the two connectors are mated, both interfaces may be used to transfer data and/or power concurrently. However, an embodiment may enable the two connectors 500, 550 to be mated in order to transfer power or data using just one of the two interface connections.

Figure 5C:
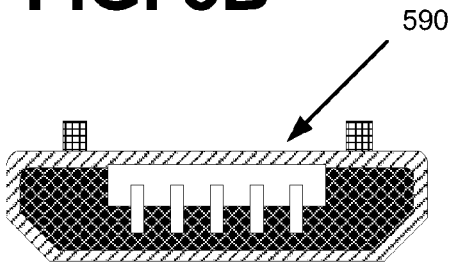
FIG. 5C is a front-end view of a plug connector that conforms to a specification for one of the interfaces of a receptacle connector of FIG. 5B.
Figure 5D:
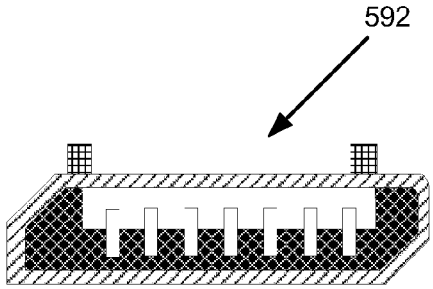
FIG. 5D is a front-end view of a another plug connector that conforms to a specification of another of the interfaces of the receptacle connector of FIG. 5B.

Embodiments such as shown by FIG. 5A and FIG. 5B may be each matable with three different connector types: one connector for each interface and a combination connector (such as shown by either FIG. 5A or FIG. 5B) that carries both interfaces. FIG. 5C and FIG. 5D are front-end views of plug connectors that may be mated with the receptacle connector 550. In FIG. 5C, a first plug connector 590 may conform to a specification such as the Micro-USB standard. Such a connector may be mated with the first connector interface 560 of receptacle connector 550. In FIG. 5D, a second plug connector 592 may provide a different arrangement or number of electrical contacts, for mating with the second connector interface 562 of the receptacle connector. As a third option, an embodiment provides that the combination plug connector 500 of FIG. 5A may be used to provide two concurrent connector interface connections.

Computing Device with Augmented Connector

Figure 6:
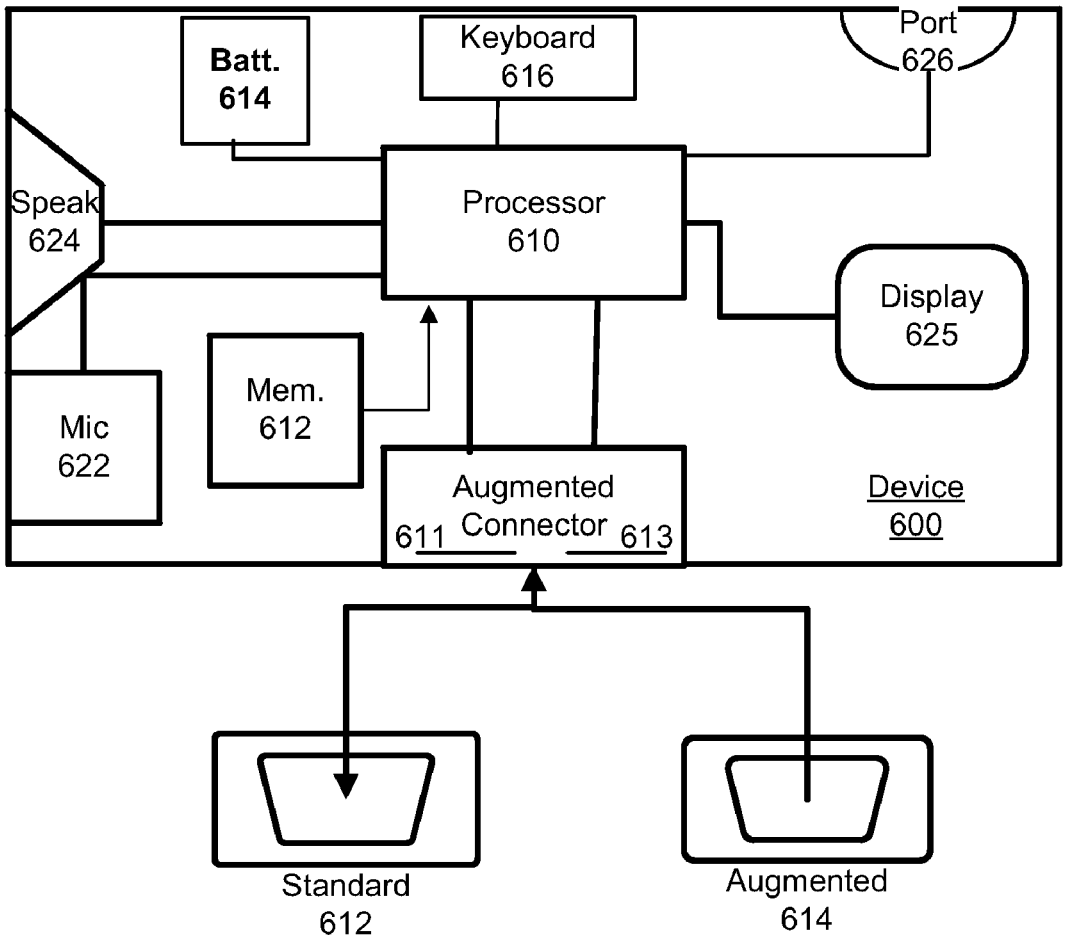
FIG. 6 is a block diagram of a computing device having a connector such as shown with any of the embodiments described herein.

FIG. 6 illustrates a computing device having an augmented connector for use in enabling the device to interface with two or more types of connectors. Embodiments provide that computing device 600 may correspond to a portable or mobile device. Examples of such devices include cellular telephony devices, media players (e.g. music or video), cameras or video records that image capture, GPS devices, and/or ultra-portable computers (e.g. execute operating system and applications similar to personal computers). Embodiments such as described may also be provided on larger devices, such as laptops or personal computers. Still further, some embodiments may be implemented on an accessory device, such as an attachment device to one of the recited mobile devices which bring added functionality. Specific examples of accessory devices include network cards or card devices, portable or ultraportable projectors, docking stations (for charging or transferring data), keyboards, camera components or cord devices.

In one implementation, the computing device 600 corresponds to a cellular telephony data device, such as a so-called "Smart phone" or "mobile companion". Such devices use cellular networks to enable telephony operations, messaging (e.g. e-mail, instant messaging, Short Message Service (SMS), Multimedia Message Service (MMS)) and Internet browsing or other network operations. As an alternative or addition, such devices may enable network connectivity through alternative wireless network mediums, such as Wireless Fidelity (or 'WiFi') as provided under standards such as those set forth by IEEE 802.11(b) or (g).

In more detail, device 600 include a processor 610 that uses various resources, such as memory resources 612, power resources 614 (on-board rechargeable battery), and various input or output devices, such as a keyboard 616, microphone 622, speaker 624, display 625 (which may be contact or touch-sensitive), and wireless communication port(s) 626 (e.g. Bluetooth, Wireless Fidelity or 802.11(b), (g) or (n) or cellular networks).

In an embodiment, the connector 610 of device 600 is capable of mating with multiple connector types. The connector 610 may mate with a first connector type 612 that enables data or power communication using a first set of contact elements 611. Additionally, the connector 610 may mate with a second connector type 614 that uses data and/or power of the first set of contact elements 611, as well as data and/or power of a second or augmenting set of contact elements 613. As described with previous embodiments, the first connector type 612 may correspond to a connector that conforms to a particular standard, such as an industry or standards body specification (e.g. Micro-USB Specification). The second connector type 614 may correspond to an augmented connector, such as described with any of the other embodiments described herein.

According to an embodiment, when connector 610 is mated with the first connector type 612, the signal lines carry data/power in conformance to a specification or design of the first connector type. This may correspond to data/power in conformance with a standard such as USB, where the signal lines include ground, voltage reference, identity, and data pair. When connector 610 is mated with the second connector type 614, additional data may be carried on the signal lines, including power and data. For example, analog data, voice and power may be carried. Table 1 and Table 2 each illustrate example pin layouts for how the contact elements 611, 613 may be used when mated with connectors of respective first type or second type.

Table 1 illustrates one configuration in which the connector of the first type 612 is a Micro-USB connector, while the connector of the second type 614 brings six additional signal lines. In the example, the first 5 pins are kept electrically compatible with Micro-USB while the added pins allow for analog audio out via pins E6-E9 and a simple serial port interface via E10 and future expansion on E11

TABLE 1

11 Pin Implementation

| Pin Name | Micro-USB | Enhanced Micro-USB |
|---|---|---|
| 1 | Vcc | Vcc |
| 2 | D– | D– |
| 3 | D+ | D+ |
| 4 | ID | ID |
| 5 | Gnd | Gnd |
| E6 | | Agnd |
| E7 | | L Audio Out |
| E8 | | R Audio Out |
| E9 | | Mic |
| E10 | | SPI |
| E11 | | Exp1 |

In the example provided by Table 2, the first 5 pins are kept electrically compatible with Micro-USB while the added pins allow for analog audio out via pins E6-E9 and a $I^2C$ Bus is included on Pin 10 and Pin 11. Pin 12 provides composite video out.

TABLE 2

12 Pin Implementation

| Pin Name | Micro-USB | Enhanced Micro-USB |
|---|---|---|
| 1 | Vcc | Vcc |
| 2 | D– | D– |
| 3 | D+ | D+ |
| 4 | ID | ID |
| 5 | Gnd | Gnd |
| E6 | | Agnd |
| E7 | | L Audio Out |
| E8 | | R Audio Out |
| E9 | | Mic |
| E10 | | I2C-Data |
| E11 | | I2C-CLK |
| E12 | | Composite Video |

Embodiments such as described enable simultaneous use of data, power charging, analog audio, and extra expansion while maintaining electrical and physical compatibility with the existing Micro-USB connector. Accordingly, embodiments described enable device 600 to use its augmented connector 610 to: (i) receive or signal power to/from its on board power resources 614, (ii) signal or receive information received over the connector 610 through one of the wireless communication port, (iii) display data on display 625, (iv) output music originating from connector 610 through speaker 624, (v) enable connection and use of microphone 622, and/or (vi) enable the manufacturer or user to supplement the functionality of the device using open signal lines on the connector (e.g. add Global Positioning System (GPS) functionality).

Numerous other applications or implementations are possible for how device 600 utilizes connector 610 and connectors of accessory devices or cables. For example, as an addition or alternative, connector 610 may be configured to enable the use of simple wire adapters, also known as pass through adapters, to enable device 600 to connect with simple accessories such as headsets (which do not require any circuitry or logic). Still further, embodiments described herein enable the use of simple pass thru adapters (also known as "Y" cables) to allows the simultaneous attachment of multiple accessories to connector 610, which can be utilized as, for example, a standard USB connector.

Although illustrative embodiments of the invention have been described in detail herein with reference to the accompanying drawings, it is to be understood that the invention is not limited to those precise embodiments. As such, many modifications and variations will be apparent to practitioners skilled in this art. Accordingly, it is intended that the scope of the invention be defined by the following claims and their equivalents. Furthermore, it is contemplated that a particular feature described either individually or as part of an embodiment can be combined with other individually described features, or parts of other embodiments, even if the other features and embodiments make no mentioned of the particular feature. This, the absence of describing combinations should not preclude the inventor from claiming rights to such combinations.

What is claimed is:

1. A small form-factor connector for a mobile computing device, the connector comprising:

a connector housing that defines a perimeter of the connector;

a mating structure positioned within the connector housing;

a first set of electrical contacts retained within an interior of the connector housing by the mating structure, wherein the first set of contacts are positioned to be received or mated with a corresponding set of contact elements of another connector in order to (i) transfer data on two or three contacts, (ii) supply a voltage signal on another of the contacts, and (iii) provide a ground for the connection formed by the two connectors; and a second set of one or more electrical contacts that are provided with one of the walls of the connector housing that form the perimeter; and a layer of insulative material provided between the second set of electrical contacts and the wall of the connector.

2. The connector of claim 1, wherein the second set of electrical contacts are provided on an exterior side of the perimeter.

3. The connector of claim 1, wherein the second set of electrical contacts are provided on an interior side of the perimeter.

4. A small form-factor connector for a mobile computing device, the connector comprising:

a connector housing having a first mating structure;

a first set of electrical contacts retained within the connector housing and having a first configuration;

a second set of electrical contacts retained within the connector and having a second configuration that is different that the first configuration;

wherein the first mating structure and the first configuration of the first set of electrical contacts enable the connector to be electrically mated with a first type of connector;

wherein the first mating structure, the first configuration of the first set of electrical contacts, and the second configuration of the second set of electrical contacts enable the connector to be electrically mated with a second type of connector; and wherein the second set of contacts are assignable when mated to carry data or power.

5. The connector of claim 4, whereon the first mating structure and the first configuration of the first set of electrical contacts configure to an organization standard.

6. The connector of claim 4, whereon the first mating structure and the first configuration of the first set of electrical contacts configure to a Micro-Universal Serial Bus (USB) standard.

7. The connector of claim 4, wherein the first set of electrical contacts are either pad or spring contacts, and wherein the second set of electrical contacts are spring contacts.

8. The connector of claim 4, wherein the first set of electrical contacts are either pad or spring contacts, and wherein the second set of electrical contacts are pad contacts.

9. The connector of claim 4, wherein the first set of electrical contacts include two default data contacts, a ground contact, a voltage reference contact, and an identity contact.

10. The connector of claim 4, wherein the second set of contacts includes between 4 and 8 contacts.

11. The connector of claim 4, wherein the first set of electrical contacts is provided by the first mating structure in an interior of the connector housing, and wherein the second set of electrical contacts is provided outside of the first mating structure.

12. The connector of claim 4, wherein the first set of electrical contacts is provided by the first mating structure in an interior of the connector housing, and wherein the connector housing includes a perimeter structure, and wherein the second set of electrical is provided on an interior of the perimeter structure.

13. The connector of claim 4, wherein the first set of electrical contacts is provided by the first mating structure in an interior of the connector housing, the first configuration corresponding to a row that is provided in the interior, and wherein the second set of electrical contacts is provided as a second row that is provided above or below the first row.

14. The connector of claim 4, wherein the connector housing includes a second structure that is positioned side-by-side to the first structure, and wherein the second set of electrical contacts is provided within the second structure.

15. The connector of claim 4, wherein the second set of electrical contacts provides one of 6, 7, 8, 9 or 10 contacts in addition to the contacts of the first set.

16. A mobile computing device comprising:

a small form-factor connector comprising:

a connector housing having a first mating structure;

a first set of electrical contacts retained within the connector housing and having a first configuration;

a second set of electrical contacts retained within the connector and having a second configuration that is different that the first configuration;

wherein the first mating structure and the first configuration of the first set of electrical contacts enable the connector to be electrically mated with a first type of connector; and wherein the first mating structure, the first configuration of the first set of electrical contacts, and the second configuration of the second set of electrical contacts enable the connector to be electrically mated with a second type of connector; and wherein the second set of contacts are assignable when mated to carry data or power.

17. The mobile computing device of claim 15, wherein the first configuration conforms to a specification promulgated by a standards body.

18. A Micro-USB connector comprising a mating structure and a set of four or five electrical contacts contained interior to the mating structure, wherein the improvement comprises a another set of one or more electrical contacts provided on a perimeter of the mating structure for carrying data; and a layer of insulative material provided between the another set of electrical contacts and the perimeter of the mating structure.

* * * * *

UNITED STATES PATENT AND TRADEMARK OFFICE

CERTIFICATE OF CORRECTION

PATENT NO. : 7,980,898 B2
APPLICATION NO. : 12/266550
DATED : July 19, 2011
INVENTOR(S) : Manjirnath Chatterjee It is certified that error appears in the above-identified patent and that said Letters Patent is hereby corrected as shown below:

In column 19, line 25, in Claim 4, delete “that” and insert -- than --, therefor.

In column 19, line 37, in Claim 5, delete “whereon” and insert -- wherein --, therefor.

In column 19, line 40, in Claim 6, delete “whereon” and insert -- wherein --, therefor.

In column 20, line 10, in Claim 12, delete “electrical is” and insert -- electrical contacts is --, therefor.

In column 20, line 32, in Claim 16, delete “that” and insert -- than --, therefor.

In column 20, line 50, in Claim 18, before “another” delete “a”.

Signed and Sealed this
Third Day of April, 2012

David J. Kappos

David J. Kappos
*Director of the United States Patent and Trademark Office*